US010907845B2

(12) United States Patent
Hancock

(10) Patent No.: US 10,907,845 B2
(45) Date of Patent: Feb. 2, 2021

(54) MULTI-FUNCTIONAL HEAT PUMP APPARATUS

(71) Applicant: Trane International Inc., Davidson, NC (US)

(72) Inventor: Stephen Stewart Hancock, Flint, TX (US)

(73) Assignee: Trane International Inc., Davidson, NC (US)

( * ) Notice: Subject to any disclaimer, the term of this patent is extended or adjusted under 35 U.S.C. 154(b) by 273 days.

(21) Appl. No.: 15/485,439

(22) Filed: Apr. 12, 2017

(65) Prior Publication Data

US 2017/0299202 A1 Oct. 19, 2017

Related U.S. Application Data

(60) Provisional application No. 62/322,042, filed on Apr. 13, 2016.

(51) Int. Cl.

| | |
|---|---|
| ***F24F 1/06*** | (2011.01) |
| ***F24F 11/30*** | (2018.01) |
| ***F25B 13/00*** | (2006.01) |
| ***F24F 3/14*** | (2006.01) |
| ***F24F 11/52*** | (2018.01) |

(Continued)

(52) U.S. Cl.

CPC ..... *F24F 11/30* (2018.01); *F24F 1/38* (2013.01); *F24F 3/14* (2013.01); *F24F 11/52* (2018.01); *F24F 11/65* (2018.01); *F25B 13/00* (2013.01); *F25B 49/02* (2013.01); *F24F 2003/144* (2013.01); *F25B 2313/02331* (2013.01); *F25B 2313/02334* (2013.01); *F25B 2313/02343* (2013.01)

(58) Field of Classification Search

CPC ..... F24F 11/30; F24F 2003/144; F25B 2313/02331

See application file for complete search history.

(56) References Cited

U.S. PATENT DOCUMENTS

| | | | |
|---|---|---|---|
| 3,257,822 | A | 6/1966 | Abbott |
| 3,627,030 | A | 12/1971 | Lorenz |

(Continued)

FOREIGN PATENT DOCUMENTS

KR 20120121583 A * 11/2012

*Primary Examiner* — Elizabeth J Martin
*Assistant Examiner* — Nael N Babaa
(74) *Attorney, Agent, or Firm* — The Salerno Law Firm, P.C.

(57) ABSTRACT

A system and related methods for heating, cooling, and dehumidifying air is disclosed. In an embodiment, the system includes an indoor unit having a first coil assembly and a second coil assembly. When the system is operating in a cooling mode or a heating mode, the first coil and second coil are in parallel fluid communication. When the system is in a dehumidifying mode, the first coil and second coil are in serial fluid communication, which enables the first coil to function as a condenser and the second coil to function as an evaporator. In an embodiment, the system includes an outdoor unit, such as a heat pump or an air conditioning condensing unit. The outdoor unit includes a heat exchanger fan responsive to dehumidifying mode by reducing fan speed, or deactivating the fan entirely. The disclosed system provides negligible or no change in sensible heat while providing dehumidification.

9 Claims, 8 Drawing Sheets

COOLING MODE

(51) Int. Cl.

| | |
|---|---|
| ***F24F 11/65*** | (2018.01) |
| ***F24F 1/38*** | (2011.01) |
| ***F25B 49/02*** | (2006.01) |

(56) References Cited

U.S. PATENT DOCUMENTS

| | | | | |
|---|---|---|---|---|
| 3,722,580 | A * | 3/1973 | Braver | F24F 1/0007 165/50 |
| 3,798,920 | A | 3/1974 | Morgan | |
| 4,040,268 | A * | 8/1977 | Howard | F25B 5/00 62/335 |
| 4,086,781 | A | 5/1978 | Brody et al. | |
| 4,739,627 | A | 4/1988 | Baumann | |
| 5,088,295 | A | 2/1992 | Shapiro-Baruch | |
| 5,311,451 | A | 5/1994 | Barrett | |
| 5,346,129 | A | 9/1994 | Shah et al. | |
| 5,461,877 | A | 10/1995 | Shaw et al. | |
| 5,537,822 | A | 7/1996 | Shnaid et al. | |
| 5,598,715 | A | 2/1997 | Edmisten | |
| 5,752,389 | A | 5/1998 | Harper | |
| 5,911,747 | A | 6/1999 | Gauthier | |
| 5,915,473 | A | 6/1999 | Ganesh et al. | |
| 5,950,709 | A | 9/1999 | Krueger et al. | |
| 5,987,908 | A | 11/1999 | Wetzel | |
| 6,012,296 | A | 1/2000 | Shah | |
| 6,079,626 | A | 6/2000 | Hartman | |
| 6,170,271 | B1 | 1/2001 | Sullivan | |
| 6,212,892 | B1 | 4/2001 | Rafalovich | |
| 6,272,873 | B1 | 8/2001 | Bass | |
| 6,381,970 | B1 | 5/2002 | Eber et al. | |
| 6,427,461 | B1 | 8/2002 | Whinery et al. | |
| 6,487,457 | B1 | 11/2002 | Hull et al. | |
| 6,557,771 | B2 | 5/2003 | Shah | |
| 6,644,049 | B2 | 11/2003 | Alford | |
| 6,672,082 | B1 | 1/2004 | Maeda et al. | |
| 6,694,756 | B1 | 2/2004 | Taras et al. | |
| 6,708,505 | B2 | 3/2004 | Nakamura et al. | |
| 6,711,907 | B2 | 3/2004 | Dinnage et al. | |
| 6,725,915 | B2 | 4/2004 | Wheat et al. | |
| 6,742,582 | B1 | 6/2004 | Wheat et al. | |
| 6,792,766 | B2 | 9/2004 | Osborne et al. | |
| 6,826,921 | B1 | 12/2004 | Uselton | |
| 6,851,621 | B1 | 2/2005 | Wacker et al. | |
| 7,055,759 | B2 | 6/2006 | Wacker et al. | |
| 7,062,930 | B2 | 6/2006 | Raybum | |
| 7,083,109 | B2 | 8/2006 | Pouchak | |
| 7,165,414 | B2 | 1/2007 | Wright | |
| 7,275,384 | B2 | 10/2007 | Taras et al. | |
| 7,341,201 | B2 | 3/2008 | Stanimirovic | |
| 7,565,813 | B2 | 7/2009 | Pouchak | |
| 7,574,871 | B2 | 8/2009 | Bloemer et al. | |
| 7,726,140 | B2 | 6/2010 | Rayburn et al. | |
| 7,845,185 | B2 | 12/2010 | Knight et al. | |
| 8,091,375 | B2 | 1/2012 | Crawford | |
| 8,147,302 | B2 | 4/2012 | Desrochers et al. | |
| 8,220,721 | B2 | 7/2012 | Flohr | |
| 8,255,087 | B2 | 8/2012 | Bennett et al. | |
| 8,397,522 | B2 | 3/2013 | Springer et al. | |
| 8,640,472 | B2 | 2/2014 | Dieckmann et al. | |
| 8,757,506 | B2 | 6/2014 | Zhou et al. | |
| 9,347,676 | B2 | 5/2016 | Uselton | |
| 2004/0211553 | A1 * | 10/2004 | Hancock | F24F 1/0007 165/260 |
| 2006/0234621 | A1 | 10/2006 | Desrochers et al. | |
| 2006/0288713 | A1 | 12/2006 | Knight et al. | |
| 2007/0138307 | A1 | 6/2007 | Khoo | |
| 2007/0257121 | A1 | 11/2007 | Chapman et al. | |
| 2007/0295477 | A1 * | 12/2007 | Mueller | F28F 13/18 165/45 |
| 2008/0156891 | A1 | 7/2008 | Zhou et al. | |
| 2008/0173035 | A1 | 7/2008 | Thayer et al. | |
| 2009/0277193 | A1 | 11/2009 | Springer et al. | |
| 2010/0071868 | A1 | 3/2010 | Reifel et al. | |
| 2010/0199652 | A1 | 8/2010 | Lemofouet et al. | |
| 2010/0298987 | A1 | 11/2010 | Bennett et al. | |
| 2010/0298989 | A1 | 11/2010 | Hess et al. | |
| 2010/0307733 | A1 | 12/2010 | Karamanos et al. | |
| 2011/0167846 | A1 | 7/2011 | Knight et al. | |
| 2013/0056177 | A1 | 3/2013 | Coutu et al. | |
| 2013/0067939 | A1 | 3/2013 | Dinh | |
| 2013/0248147 | A1 | 9/2013 | Wintemute et al. | |
| 2014/0129197 | A1 | 5/2014 | Sons et al. | |
| 2014/0260367 | A1 | 9/2014 | Coutu et al. | |
| 2015/0247646 | A1 | 9/2015 | Song et al. | |

* cited by examiner

COOLING MODE

HEATING MODE

DEHUMIDIFYING MODE

MULTI-FUNCTIONAL HEAT PUMP APPARATUS

CROSS-REFERENCE TO RELATED APPLICATION

This application claims the benefit of and priority to U.S. Provisional Application Ser. No. 62/322,042 entitled "MULTI-FUNCTIONAL HEAT PUMP APPARATUS" and filed Apr. 13, 2016, the entirety of which is hereby incorporated by reference herein for all purposes.

BACKGROUND

1. Technical Field

The present disclosure relates to heat pumps and air conditioning systems used for adjusting temperature and humidity within a space and, more particularly, to a multi-functional heat pump apparatus capable of independently heating, cooling, and dehumidifying air supplied to the space.

2. Background of the Related Art

Air conditioners not only cool the indoor environment, usually they simultaneously dehumidify it. During the summer months, this typically works well because the system runs regularly to keep the space cool and dry. However, in the "bridge months" of spring and fall when there is little demand for air conditioning, the system does not run and therefore cannot dehumidify the air, which can lead to overly-humid indoor conditions. Furthermore, conditions may exist where air in the space is at a comfortable temperature, in the range of about 70° to 75° F., but the relative humidity remains uncomfortably high. In these conditions, a conventional cooling system is capable of dehumidification only by further cooling the air in the space, thus lowering the temperature to a level that is uncomfortable to the occupants.

Conventional approaches to addressing this problem include acquiring a stand-alone dehumidifier for the home, or running the air conditioning system to dehumidify the air then re-heating the supply air to keep from over-cooling the space. These approaches have drawbacks in that they are often expensive to install and require the addition of more equipment, plumbing, and refrigerant. Furthermore, conventional air conditioning systems may suffer decreased efficiency due to the additional pressure drop of the reheat heat exchanger(s) which increase fan power requirements, or the additional energy required to re-heat the supply air. A compact, efficient, and economical air conditioning system which independently heats, cools, and dehumidifies air in a space as required throughout the year would be a welcome advance in the art.

SUMMARY

The present disclosure addresses the above mentioned need for an economical heat pump system which heats, cools, and dehumidifies air in a space consistently throughout the year. Furthermore, the disclosure addresses the need for a heat pump system capable of dehumidifying air and simultaneously keeping temperature of the space comfortable for one or more occupants. The multi-functional heat pump system for separately heating, cooling, and dehumidifying air disclosed herein includes at least two portions of an indoor heat exchanger, a compressor, a reversing valve, a thermal expansion valve/check valve combination, an outdoor heat exchanger, and a three-way switching valve. The indoor heat exchangers exchange heat between a working medium and air to be conditioned. The indoor heat exchangers operate as parallel evaporators downstream of the outdoor heat exchanger in cooling mode, as parallel condensers upstream of the outdoor heat exchanger in heating mode, and is series, the first as a condenser and the second as an evaporator downstream of the outdoor heat exchanger in dehumidifying mode. The indoor heat exchangers receive the working medium from the thermal expansion valve in cooling mode, from the compressor in heating mode, and the first from the outdoor heat exchanger and the second from the thermal expansion valve via an auxiliary circuit in the dehumidifying mode. The reversing valve reverses flow through the heat exchangers and the thermal expansion valve reduces pressure of the working medium. The outdoor heat exchanger exchanges heat between the working medium and outside air. The three-way switching valve switches flow of the working medium through the indoor heat exchangers from parallel operation in heating and cooling modes to series operation in dehumidifying mode.

In one aspect, the present disclosure is directed to an indoor unit for use with a heating, ventilation, and air conditioning system. In an example embodiment, the indoor unit includes an enclosure, a first coil assembly, and a second coil assembly. In a cooling mode or a heating mode, the first coil and second coil are arranged in parallel fluid communication, and in a dehumidifying mode the first coil and second coil are arranged in serial fluid communication. In some embodiments of the indoor unit, the first coil assembly and the second coil comprise first and second portions, respectively, of a single coil assembly.

In some embodiments, the first and/or second coil assembly forms a heat exchanger having first and second ends. A thermal expansion valve is coupled in series with a first end of the heat exchanging coil, and a reverse bypass valve is coupled in parallel with the thermal expansion valve.

In some embodiments, the indoor unit includes a first fluid circuit and a bypass fluid circuit, and a three-way valve which, in the cooling mode or the heating mode, directs working medium between the first fluid circuit and a first end of the first coil assembly and a first end of the second coil assembly. In the dehumidifying mode, the three-way valve directs working medium between the first fluid circuit and a second end of the first coil assembly.

In some embodiments, the indoor unit includes a second fluid circuit, and a solenoid valve. In the cooling mode or the heating mode, the solenoid valve directs working medium between the second fluid circuit and a second end of the first coil assembly and a second end of the first coil assembly. In the dehumidifying mode, the solenoid valve directs working medium between the second fluid circuit and a second end of the second coil assembly and prevents working fluid from flowing between the second fluid circuit and the second end of the first coil assembly.

In some embodiments, the indoor unit includes a controller adapted to receive a control signal indicating an indoor unit state selected from the group consisting of cooling mode, heating mode, and dehumidifying mode. In some embodiments, when the controller receives a control signal indicating an indoor unit state of cooling mode or heating mode, the controller causes the first coil assembly and the second coil assembly to be configured in parallel fluid communication. In some embodiments, when the controller receives a control signal indicating an indoor unit state of dehumidifying mode, the controller causes the first coil assembly and the second coil assembly to be configured in a serial fluid communication.

In another aspect, the present disclosure is directed to a method of operating a heating, cooling, and ventilation system to condition air of a given space. In an example embodiment, the method includes providing an indoor unit comprising a first coil assembly and a second coil assembly, wherein the first coil assembly and the second coil assembly are individually configurable to operate in a heating mode or a cooling mode. The method includes cooling air of a given space by operating the first coil assembly and the second coil assembly in a cooling mode, heating air of a given space by operating the first coil assembly and the second coil assembly in a heating mode, and dehumidifying air of a given space by operating the first coil assembly in a heating mode and operating the second coil assembly in a cooling mode.

In some embodiments, cooling air of a given space includes coupling the first coil assembly and the second coil assembly in a parallel configuration. In some embodiments, the method includes operating the first coil assembly and the second coil assembly as evaporator coils.

In some embodiments, heating air of a given space includes coupling the first coil assembly and the second coil assembly in a parallel configuration. In some embodiments, the method includes operating the first coil assembly and the second coil assembly as condenser coils.

In some embodiments, dehumidifying air of a given space includes coupling the first coil assembly and the second coil assembly in a series configuration. In some embodiments, the method includes operating the first coil assembly as a condenser coil and operating the second coil assembly as an evaporator coil.

In some embodiments, dehumidifying air of a given space includes reducing the speed of an outdoor coil fan of an outdoor unit coupled to the indoor unit. In some embodiments, dehumidifying air of a given space includes deactivating an outdoor coil fan of an outdoor unit coupled to the indoor unit.

In yet another aspect, the present disclosure is directed to a system for heating, cooling, and dehumidifying air of a given space. In an exemplary embodiment, the system includes a thermostat and an indoor unit. The thermostat includes a graphical user interface for rendering information and displaying a selection of a plurality of modes and to receive a selection of a mode from a user. The thermostat includes at least one processor configured to execute computer program instructions defined by modules of the thermostat. The thermostat modules include a data communications module configured to receive sensor data variables from one or more sensing devices, the sensing devices configured to send an environmental parameter of the given space; an analysis module configured to dynamically analyze the received sensor data variables to determine an environmental state of the given space and generate a control signal based on based on the received mode selection and the determined state of the given space; and a control module operatively coupled to the thermostat and configured to control one or more auxiliary units based on the control signal. The indoor unit includes a first coil assembly, a second coil assembly, and one or more auxiliary units operatively associated with the first coil assembly and the second coil assembly. The auxiliary unit is responsive to the control module to configure the first and second coils in one of a cooling mode, heating mode, or a dehumidifying mode. In a cooling mode or a heating mode, the auxiliary unit configures the first coil and second coil to operate in parallel fluid communication. In a dehumidifying mode, the auxiliary unit configures the first coil and second coil to operate in serial fluid communication.

In some embodiments, the one or more sensing devices generate a variable indicative of any one, some, or all of an ambient temperature, an ambient pressure, and/or an ambient humidity of the given space.

In some embodiments, the auxiliary unit is selected from the group consisting of a three way valve and a solenoid valve.

In some embodiments, the system includes an outdoor unit having a heat exchanger fan, wherein the control module is in communication with the heat exchanger fan and is configured to operate the heat exchanger fan of the outdoor unit at reduced speed during dehumidifying mode. In some embodiments, the control module is configured to deactivate the heat exchanger fan of the outdoor unit during dehumidifying mode.

Other features and advantages will become apparent from the following description of the preferred embodiments, taken in conjunction with the accompanying drawings.

BRIEF DESCRIPTION OF THE DRAWINGS

Various embodiments of the disclosed system and method are described herein with reference to the accompanying drawings, which form a part of this disclosure, wherein.

Figure 1A:
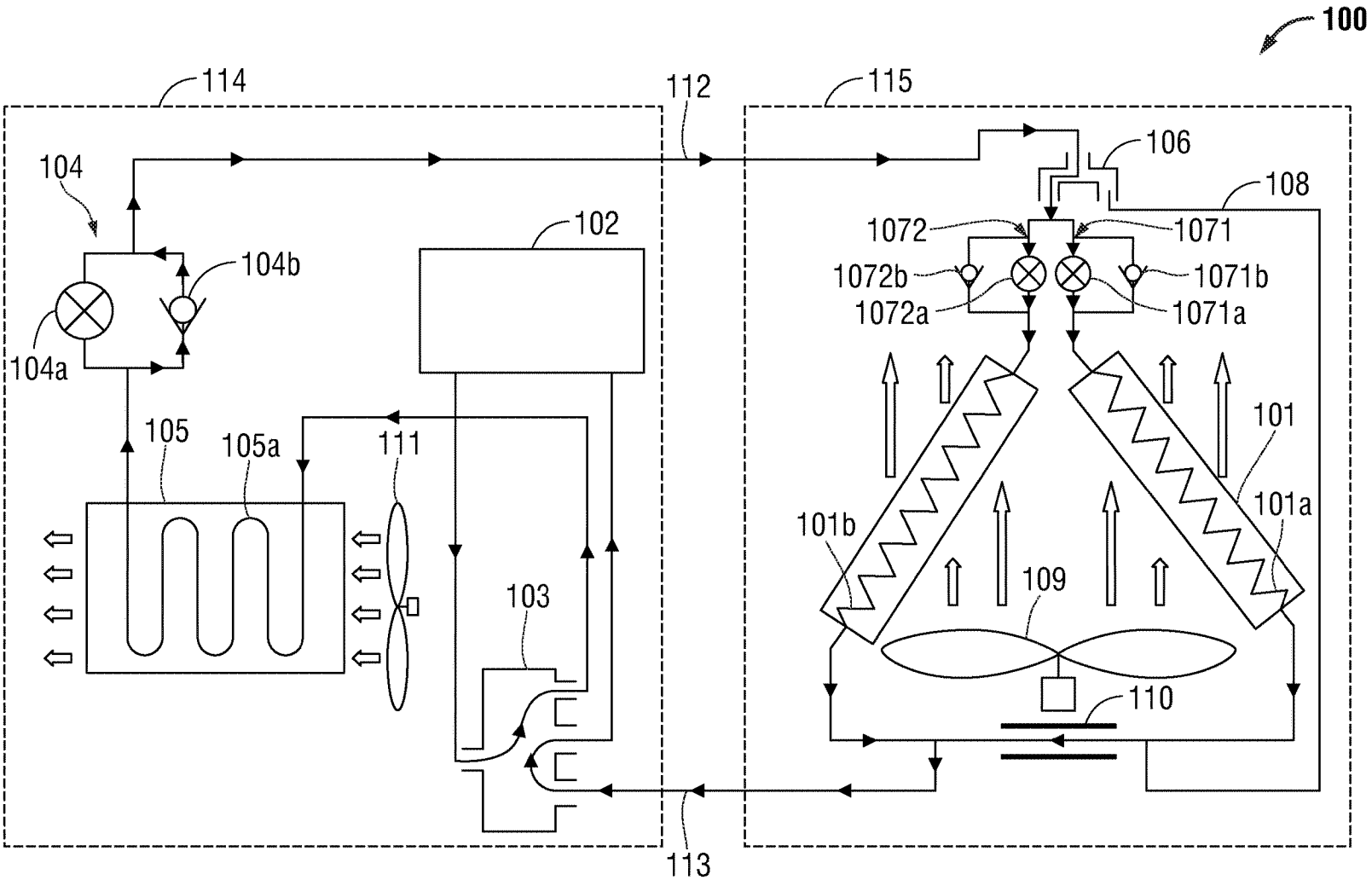
FIG. 1A is a schematic diagram of a multi-functional heat pump apparatus operating in cooling mode in accordance with an embodiment of the present disclosure.

The various aspects of the present disclosure mentioned above are described in further detail with reference to the aforementioned figures and the following detailed description of exemplary embodiments.

DETAILED DESCRIPTION

Particular illustrative embodiments of the present disclosure are described herein below with reference to the accompanying drawings; however, the disclosed embodiments are merely examples of the disclosure, which may be embodied in various forms. Well-known functions or constructions and repetitive matter are not described in detail to avoid obscuring the present disclosure in unnecessary or redundant detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In this description, as well as in the drawings, like-referenced numbers represent elements which may perform the same, similar, or equivalent functions. The word "exemplary" is used herein to mean "serving as an example, instance, or illustration." Any embodiment described herein as "exemplary" is not necessarily to be construed as preferred or advantageous over other embodiments. The word "example" may be used interchangeably with the term "exemplary." To facilitate the explanation and description of the features of the example embodiments, terms such as "top," "bottom," "upper," "lower," "left," "right" and so forth may be used with reference to the drawings. However the use of such terms describing orientation should not be viewed as limiting either on the use of the invention, or the breadth of the claims to follow.

The present disclosure is directed to a multi-functional heat pump apparatus for heating, cooling, and dehumidifying air of a space. In an embodiment, the multi-functional heat pump apparatus comprises two indoor heat exchangers, a compressor, a reversing valve, a thermal expansion valve, an outdoor heat exchanger, and a three-way switching valve. The two indoor heat exchangers exchange heat between a working medium and the air to be conditioned. In cooling mode, the indoor heat exchangers are configured in parallel and act as evaporators. In heating mode, the indoor heat exchangers are configured in parallel and act as condensers. In dehumidifying mode, the indoor heat exchangers are configured in series where one acts a condenser to heat the air to be conditioned and the other acts as an evaporator to cool and dehumidify the air to be conditioned. This arrangement provides effective dehumidification with little or no change in sensible heat (temperature) of the air to be conditioned as the sensible heating from one indoor heat exchanger largely neutralizes the sensible cooling from the other. The indoor heat exchangers receive the working medium from the thermal expansion valve in cooling mode, from the compressor in heating mode, and from the thermal expansion valve via an auxiliary circuit in the dehumidifying mode. The reversing valve reverses flow and the thermal expansion valve reduces pressure of the working medium. The outdoor heat exchanger exchanges heat between the working medium and outside air. The three-way switching valve switches flow of the working medium.

With reference to FIG. 1A, an example embodiment of a multi-functional heat pump apparatus 100 operating in cooling mode is shown. The multi-functional heat pump apparatus 100 comprises an outdoor unit 114 and an indoor unit 115. Outdoor unit 114 includes a compressor 102, reversing valve 103, outdoor heat exchanger 105, and a thermal expansion device 104 that includes a thermal expansion valve (TXV) 104*a* and a reverse bypass valve 104*b*, and an outdoor fan unit 111. Indoor unit 115 includes at least two indoor heat exchangers 101*a* and 101*b*, a three-way switching valve 106 and a solenoid valve 110; thermal expansion device 1071 that includes TXV 1071*a* and reverse bypass valve 1071*b*, thermal expansion device 1072 that includes TXV 1072*a* and reverse bypass valve 1072*b*, and indoor blower unit 109.

In cooling mode, the working medium is received from outdoor unit 114 via fluid circuit 112 and flows through the three-way switching valve 106, through TXV 1071*a* and TXV 1072*a* and into the upper connection of indoor coils 101*a* and 101*b*, respectively. The working medium exits via the lower connection of indoor coils 101*a* and 101*b* and returns to outdoor unit 114 via fluid circuit 113, then reaches the compressor 102 via the reversing valve 103. The working medium then flows to the outdoor heat exchanger 105 and back to the three-way switching valve 106 to repeat the vapor-compression cycle.

In the illustrated embodiments, TXV device 104 incorporates a bypass check valve 104*b* that enables the working medium to bypass TXV 104*a* when flowing in the reverse direction from the operative direction of TVX 104*a*, as will be readily understood with reference to the drawings and description herein. In embodiments, TXV 104*a* and check valve 104*b* are integral to TXV device 104. In other embodiments, TXV 104*a* and check valve 104*b* are individual units that are plumbed together. TXV devices 1071 and 1072 may similarly be configured as integral or individual TVX components, as desired.

As used herein "working medium" refers to a refrigerant. A refrigerant is a substance or mixture, usually a fluid, used in a heat pump and refrigeration cycle. In most cycles the refrigerant undergoes phase transitions from a liquid to a gas and back again. Refrigerants having favorable thermodynamic properties and are noncorrosive to mechanical components, for example, non-halogenated hydrocarbons, chlorofluorocarbons, etc., are used. In an embodiment, the working medium is R-410A refrigerant.

The indoor heat exchanger 101 comprises indoor coils 101*a* and 101*b* which are of similar size and configured in an A-shaped geometry or a V-shaped geometry as will be familiar to the skilled artisan. In cooling mode, the flow of the working medium through both indoor coils 101*a*, 101*b* of the indoor heat exchanger 101 is in the same direction. That is, the indoor coils 101*a*, 101*b* of indoor heat exchanger 101 are configured in a parallel configuration in cooling mode as illustrated in FIG. 1A. The working medium flows from the three-way valve 106, through the TXV valve 1072 and the indoor heat exchangers 101*a* and 101*b* to the vapor line 113 which will carry the working medium back to the outdoor unit 114 as illustrated in FIG. 1A. The three-way switching valve 106 switches fluid communication between TXV valves 1071*a* and 1072*a*, and an auxiliary circuit 108 based on the mode selected by the user or system controller. In cooling and heating mode, three-way valve 106 couples fluid circuit 112 with TXV valves 1071*a* and 1072*a*. In dehumidification mode, three-way valve 106 couples fluid circuit 112 with auxiliary circuit 108. Thus, in cooling mode, the working medium flows through TXV valves 1071*a* and 1072*a*, and through the indoor coils 101*a* and 101*b* of indoor heat exchanger 101. Having passed through the TXV valves, the working medium is at a cold temperature, the air from the indoor fan 109 exchanges heat with the cold indoor heat exchanger 101, and cold air is supplied to the space to be cooled, while the working medium absorbs heat from the hot air and changes phase from liquid to vapor. The working medium exits indoor coils 101*a*, 101*b*, and flows to the compressor 102 via the reversing valve 103. A solenoid valve 110 is positioned between indoor coils 101*a*, 101*b* and cooperates with three way valve 106 to configure indoor coils 101*a*, 101*b* in a parallel configuration while in cooling and heating mode illustrated in FIGS. 1A and 1B, respectively, and in a serial configuration while in dehumidification mode as illustrated in FIG. 1C.

The working medium vapor is compressed by the compressor 102 to high pressure, increasing the temperature of the working medium. High pressure high temperature working medium flows to the outdoor heat exchanger 105. The outdoor fan 111 blows outside air over the outdoor coils

105*a* of the outdoor heat exchanger 105 to exchange heat of the hot working medium with the outside air, condensing the working medium from vapor to liquid. The low temperature high pressure working medium liquid bypasses TXV 104*a* via check valve 104*b*, flows through fluid circuit 112 and three-way valve 106 to TXV valves 1071*a* and 1072*a* to lower the pressure and saturation temperature of the working medium. The low pressure working medium is passed to the indoor heat exchanger 101 where heat from the indoor airstream evaporates the liquid working medium to vapor again to complete and repeat the vapor-compression cooling cycle. In this way, the space is cooled to the setpoint temperature, providing comfort for the occupant(s).

Notably, the disclosed use of two individual TXV valves 1071*a* and 1072*a* for indoor coils 101*a* and 101*b* allows the use of smaller TVX units rather than the conventional arrangement of one larger TXV for both indoor coils, which provides a second benefit. The disclosed arrangement greatly reduces or eliminates the chance of an imbalance condition between the two indoor coils 101*a*, 101*b* of the indoor heat exchanger 101, also known as a flooding/starving condition, while in cooling mode. In this scenario, one indoor coil 101*a* may experience less airflow, causing it to run colder, which results in more condensation on the indoor coil 101*a*, which further restricts airflow, resulting in a self-reinforcing cycle causing a flooding condition. The other indoor coil 101*b* may experience greater airflow and run warmer, creating a self-reinforcing starvation condition. The provision of two TXV valves 1071*a* and 1072*a* ensures the refrigerant flow to each indoor coil 101*a* and 101*b* is self-regulated by its respective TXV device which avoids the onset of an imbalance condition.

Figure 1B:
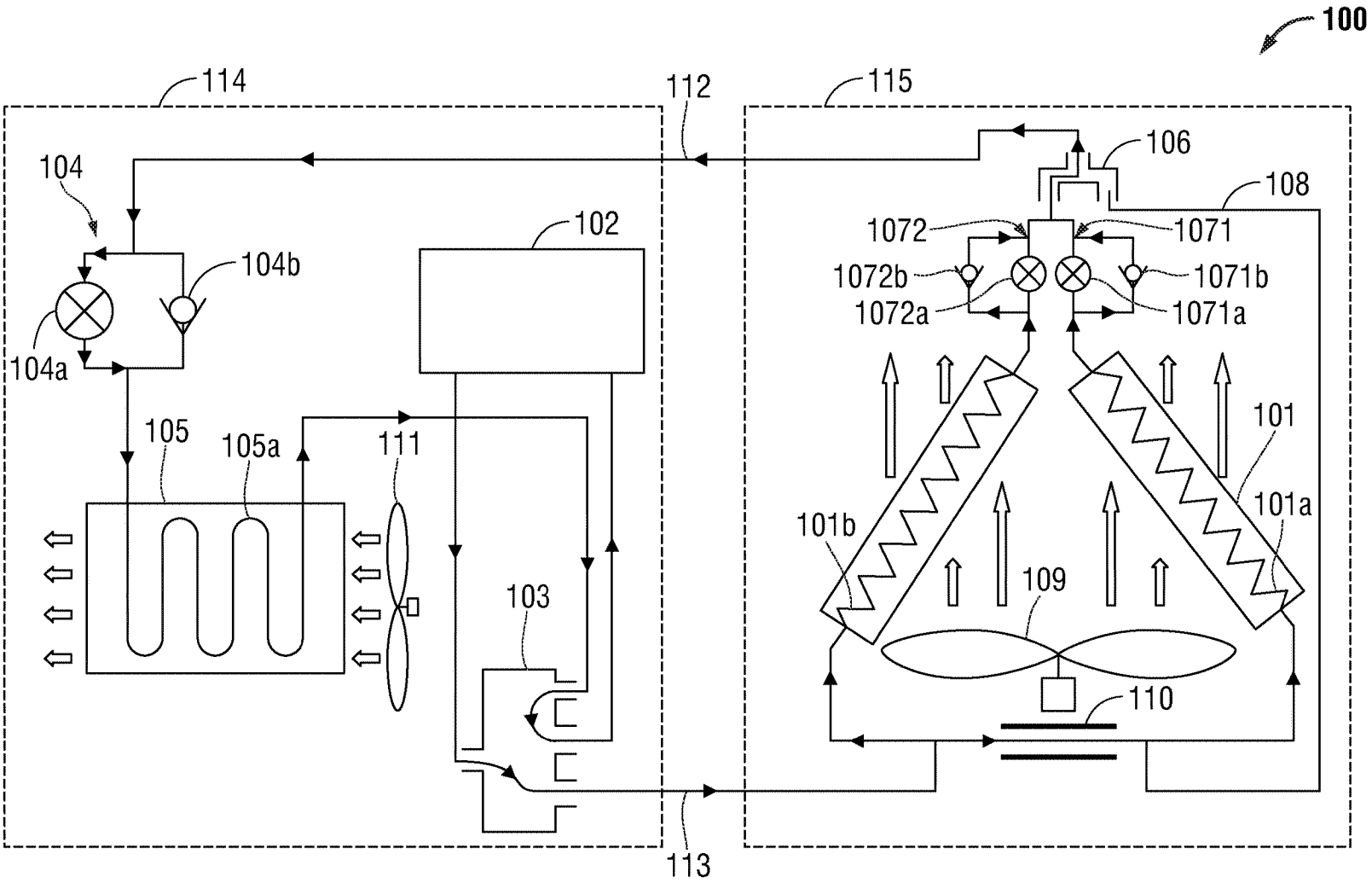
FIG. 1B is a schematic diagram of a multi-functional heat pump apparatus operating in heating mode in accordance with an embodiment of the present disclosure.
Figure 1C:
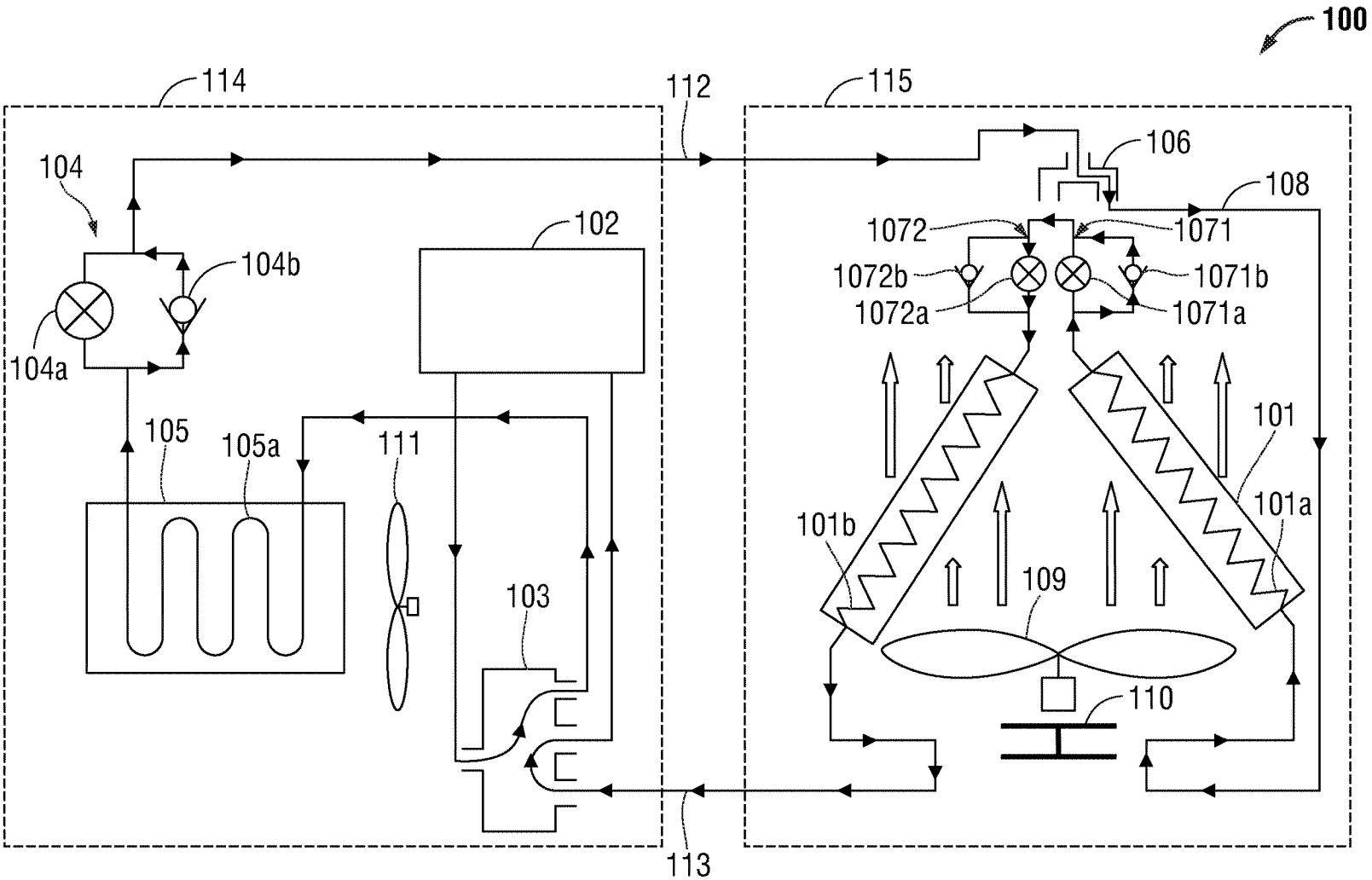
FIG. 1C is a schematic diagram of a multi-functional heat pump apparatus operating in dehumidifying mode in accordance with an embodiment of the present disclosure.

FIG. 1B is a schematic diagram of a multi-functional heat pump apparatus operating in heating mode. In heating mode, the flow of the working medium is reversed. The reversal of flow is accomplished by the reversing valve 103. In heating mode, the functions of the outdoor coils and indoor coils are swapped, that is, the indoor heat exchanger 101 functions as a condenser of a conventional vapor compression system and the outdoor heat exchanger 105 functions as an evaporator of a conventional vapor compression system. In heating mode, the outdoor heat exchanger 105 receives low pressure low temperature working medium from TXV 104*a*. The working medium further absorbs heat evaporating from liquid to vapor as it passes through the outdoor coil 105*a* of the outdoor heat exchanger 105. The outdoor fan 111 blows outside air over the outdoor heat exchanger 105 from which the working medium draws heat. The working medium next is compressed by the compressor 102 to a high temperature high pressure working medium vapor. The high temperature high pressure working medium flows to the indoor heat exchangers 101 via fluid circuit 113. Solenoid valve 110 is in the open position, thus enabling working medium to flow to into the lower connection of both indoor coils 101*a* and 101*b*. Since three way valve 106 is in the cooling/heating position, working medium does not appreciably flow into the auxiliary circuit 108 even though the solenoid valve 110 is open. Both coils 101*a* and 101*b* of the indoor heat exchangers 101 thus contain high temperature high pressure working medium vapor. The indoor fan 109 blows indoor air over the indoor heat exchanger 101, the heated working medium transfers a portion of its heat to the indoor air, and thus warmed air is supplied to the indoor space to be heated. The cooled working medium bypasses TXV valves 1071*a* and 1072*a* via their respective check valves 1071*b* and 1072*b*. The working medium then exits the indoor coils 101*a* and 101*b*, and flows through the three-way switching valve 106 and exits indoor unit 115. The working medium continues to flow to TXV 104*a* of outdoor unit 114 via fluid circuit 112. TXV 104*a* reduces the pressure of the working medium liquid to produce low temperature low pressure working medium and the vapor-pressure cycle repeats.

FIG. 1C is a schematic diagram of a multi-functional heat pump apparatus 100 operating in dehumidifying mode. In dehumidifying mode, the 4-way reversing valve 103 is configured for cooling mode and the indoor heat exchanger 101 is in a series configuration. That is, the flow of the working medium is from the outdoor heat exchanger 105 to indoor coil 101*a*, which now functions as a condenser, from indoor coil 101*a* through TXV 1072*a*, and into indoor coil 101*b* which now functions as an evaporator. In the illustrated embodiment, this flow configuration is achieved by closing solenoid valve 110 and switching three-way switching valve 106 to dehumidifying mode. In dehumidifying mode, three-way switching valve 106 directs flow to indoor coil 101*a* via the auxiliary circuit 108, while the closed solenoid valve 110 between the indoor heat exchangers 101 causes working medium to flow serially from indoor coil 101*a* to indoor coil 101*b*, as shown in FIG. 1C. Indoor coil 101*a* acts as a condenser and effectively functions as an extension of outdoor coil 105 (which, in dehumidifying mode and cooling mode, acts as a condenser due to the setting of reversing valve 103). The working medium exchanges heat with the air blown from the indoor fan 109, warming the air flowing across indoor coil 101*a*. Working medium then flows from indoor coil 101*a*, bypasses TXV 1071*a* via check valve 1071*b*, and proceeds into TXV 1072*a* where it expands and cools before entering indoor coil 101*b*, which is now functioning as an evaporator and thus cools and removes moisture from the air flowing across indoor coil 101*b*. The working medium exits indoor coil 101*b* and returns to outdoor unit 114 via fluid circuit 113, then reaches the compressor 102 via the reversing valve 103. The working medium then flows to the outdoor heat exchanger 105 and back to the three-way switching valve 106 to repeat the vapor-compression cycle.

In some embodiments, while in dehumidifying mode, the outdoor fan 111 is operated at reduced speed, or turned off completely. This effectively decrease the amount of heat exchange occurring at outdoor coil 105*a* and thus increases the amount of heat available to indoor coil 101*a* to more effectively warm the indoor air and achieve minimal change in sensible heat. Indeed, since the heating capacity of indoor coil 101*a* of indoor heat exchanger 101 is approximately equal to the sensible capacity of indoor coil 101*b* of indoor heat exchanger 101, when the air exiting indoor coils 101*a* and 101*b* is mixed, there is very little temperature change between the entering and exiting air. Thus, substantial dehumidification is achieved with little or no change in temperature. The value of the disclosed dehumidifying mode is that it decouples the latent and sensible capacities of multi-functional heat pump apparatus 100. This is advantageous in times of low sensible load but significant latent load like nighttime in humid climates and "bridge months" between heating and cooling.

Figure 2:
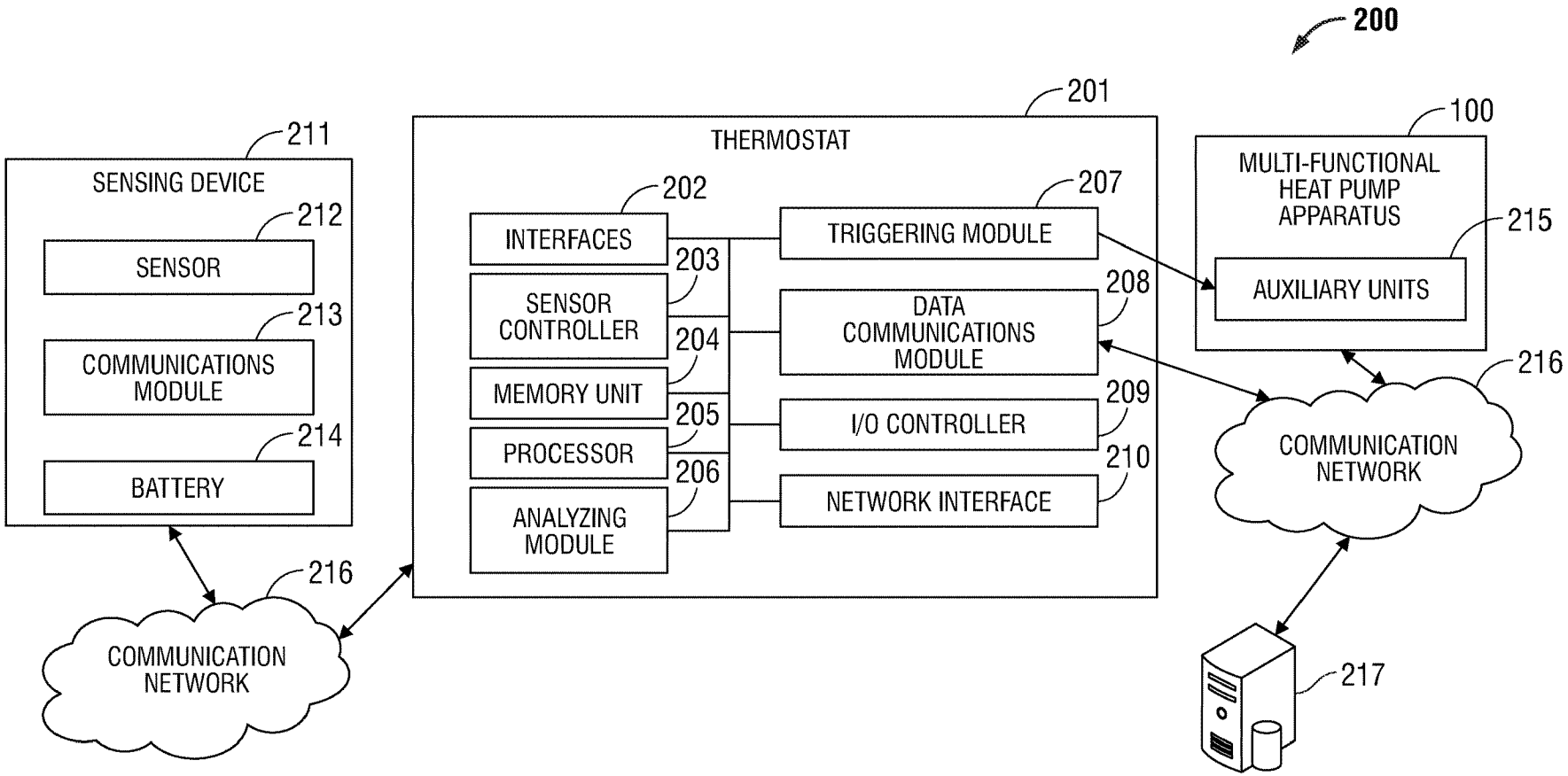
FIG. 2 is a block diagram showing the components of a multi-functional heat pump system in accordance with an embodiment of the present disclosure.

FIG. 2 is a block diagram showing components of a multi-functional heat pump system 200 in accordance with an embodiment of the present disclosure. The multi-functional heat pump system 200 comprises a thermostat/humidistat 201, one or more sensing devices, and the multi-functioning apparatus 100. The thermostat 201 monitors a space to be air conditioned, heated and/or dehumidified. The thermostat 201 comprises one or more interfaces 202, a sensor controller 203, a memory unit 204, at least one processor 205, an analyzing module 206, a triggering module 207, a data communications module 208, an I/O controller 209, and a network interface 210. The multiple interfaces 202 connect one or more sensing devices 211 to the thermostat 201. The multiple interfaces 202 are, for example, one or more bus interfaces, a wireless interface, etc. As used herein, "bus interface" refers to a communication system that transfers data between components inside a computing device and between computing devices. In embodiments, a separate thermostat and humidistat may be employed, and, additionally or alternatively, one or more separate system controllers that are in communication with one or more separate temperature and/or humidity sensors.

As used herein, the "computing device" is an electronic device, for example, a personal computer, a tablet computing device, a mobile computer, a mobile phone, a smart phone, a portable computing device, a laptop, a personal digital assistant, a wearable device such as the Google Glass™ of Google Inc., the Apple Watch® of Apple Inc., etc., a touch centric device, a workstation, a server, a client device, a portable electronic device, a network enabled computing device, an interactive network enabled communication device, a gaming device, a set top box, a television, an image capture device, a web browser, a portable media player, a disc player such as a Blu-ray Disc® player of the Blu-ray Disc Association, a video recorder, an audio recorder, a global positioning system (GPS) device, a theater system, any entertainment system, any other suitable computing equipment, combinations of multiple pieces of computing equipment, etc.

In an embodiment, the electronic device is a hybrid device that combines the functionality of multiple devices. Examples of a hybrid electronic device comprise a cellular telephone that includes media player functionality, a gaming device that includes a wireless communications capability, a cellular telephone that includes game and electronic mail (email) functions, and a portable device that receives email, supports mobile telephone calls, has music player functionality, and supports web browsing. In an embodiment, computing equipment is used to implement applications such as media playback applications, for example, iTunes® from Apple Inc., a web browser, a mapping application, an electronic mail (email) application, a calendar application, etc. In another embodiment, computing equipment, for example, one or more servers are associated with one or more online services.

In another embodiment, the sensing devices 211 are connected to the thermostat 201 via a communication network 216. The communications network 216 is a network, for example, the internet, an intranet, a wired network, a wireless network, a communication network that implements Bluetooth® of Bluetooth SIG, Inc., a network that implements Wi-Fi® of Wi-Fi Alliance Corporation, an ultra-wideband communication network (UWB), a wireless universal serial bus (USB) communication network, a communication network that implements ZigBee® of ZigBee Alliance Corporation, a general packet radio service (GPRS) network, a mobile telecommunication network such as a global system for mobile (GSM) communications network, a code division multiple access (CDMA) network, a third generation (3G) mobile communication network, a fourth generation (4G) mobile communication network, a long-term evolution (LTE) mobile communication network, a public telephone network, etc., a local area network, a wide area network, an internet connection network, an infrared communication network, etc., or a network formed from any combination of these networks. The sensing device 211 comprises one or more sensors 212, a communications module 213, and a battery 214 as a power source.

In an embodiment, the one or more sensing devices 211 include, for example, temperature sensing devices, pressure sensing devices, and humidity sensing devices, and so forth. The one or more sensing devices 211 detect temperature, pressure, humidity, etc., of the given space. The one or more sensors 212 generate multiple sensor data variables based on the ambient temperature, ambient pressure, ambient humidity, etc., of the given space. The memory unit 204 stores the generated sensor data variables. The processor 205 is communicatively coupled to the memory unit 204. The processor 205 is configured to execute the computer program instructions defined by the multi-functional heat pump system 200. The processor 205 refers to any one or more microprocessors, central processor (CPU) devices, finite state machines, computers, microcontrollers, digital signal processors, logic, a logic device, an user circuit, an application specific integrated circuit (ASIC), a field-programmable gate array (FPGA), a chip, etc., or any combination thereof, capable of executing computer programs or a series of commands, instructions, or state transitions. In an embodiment, the processor 205 is implemented as a processor set comprising, for example, a programmed microprocessor and a math or graphics co-processor. The processor 205 is selected, for example, from the Intel® processors such as the Itanium® microprocessor or the Pentium® processors, Advanced Micro Devices (AMD®) processors such as the Athlon® processor, UltraSPARC® processors, microSPARC® processors, HP® processors, International Business Machines (IBM®) processors such as the PowerPC® microprocessor, the MIPS® reduced instruction set computer (RISC) processor of MIPS Technologies, Inc., RISC based computer processors of ARM Holdings, Motorola® processors, Qualcomm® processors, etc. The multi-functional heat pump system 200 disclosed herein is not limited to employing a processor 205. In an embodiment, the multi-functional heat pump system 200 employs a controller, a microcontroller, and/or a gate array device. The processor 205 executes the modules, for example, 203, 206, 207, 208, etc., of the multi-functional heat pump system 200.

The analyzing module 206 analyzes the generated sensor data variables to recognize a state of the given space based on existing sensor data variables stored in the memory unit 204. The triggering module 207 triggers one or more auxiliary units 215 based on the recognized state of the given space or an input received from a user via the I/O controller 209. The auxiliary units 215 include, for example, the solenoid valve 110, the reversing valve 103, and the three-way switching valve 106, etc., exemplarily illustrated in FIGS. 1A-1C. In an embodiment, the data communications module 208 is configured to transmit the generated sensor data variables to a server 217 via the communication network 216. This enables remote access to data regarding the state of the given space. In an embodiment, the triggering module 207 transmits the necessary signals to the solenoid valve 110 and the outdoor fan 111 to switch between heating, cooling, and dehumidifying modes in response to sensor data variables received from the sensing devices 211. A user may specify a desired relative humidity set point. In an embodiment, the thermostat 201 provides pre-selected humidity comfort zones. The dehumidifying mode is triggered based on any one, some, or all of an ambient indoor temperature, set point temperature, outdoor temperature, indoor humidity, set point humidity, outdoor humidity, season or time-of-year, and weather forecast data.

Figure 3:
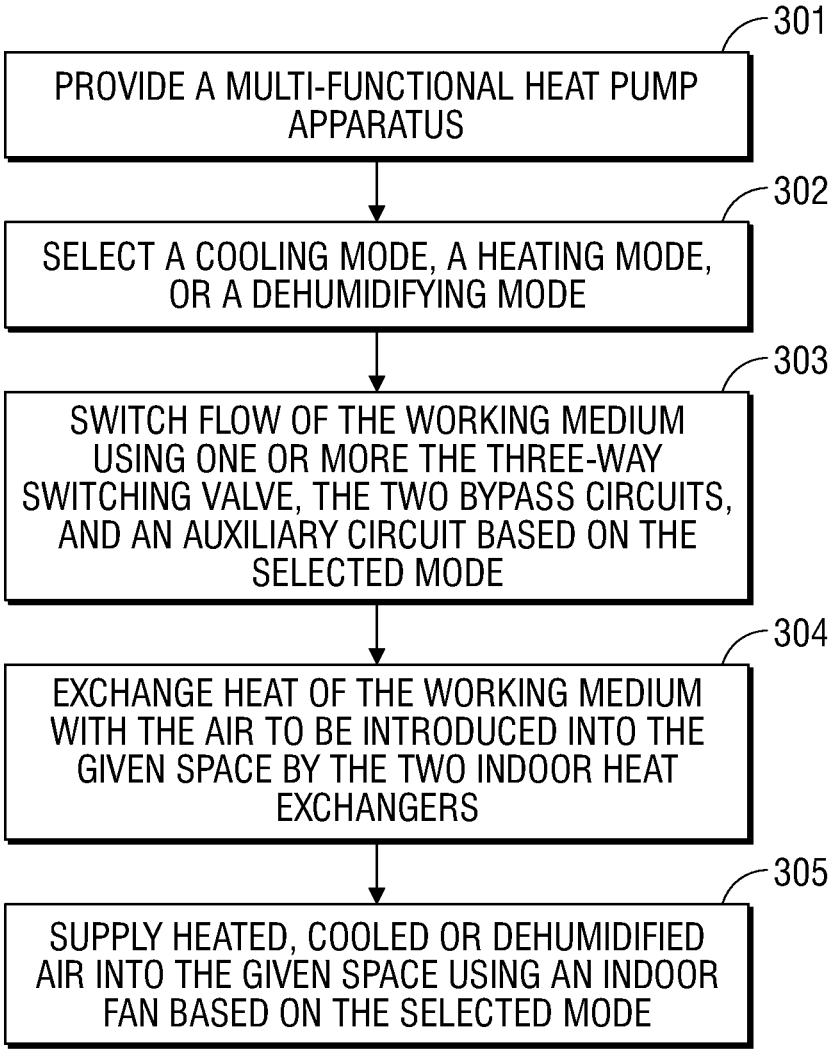
FIG. 3 illustrates a method for heating, cooling, and dehumidifying air in a given space in accordance with an embodiment of the present disclosure.

FIG. 3 illustrates a method for heating, cooling, and dehumidifying air in a given space in accordance with an embodiment of the present disclosure. In the disclosed method, a multi-functional heat pump apparatus includes at least two indoor heat exchangers 101, a compressor 102, a reversing valve 103, a thermal expansion valve 104, an outdoor heat exchanger 105, and a three-way switching valve 106 is provided 301 as exemplarily illustrated in FIGS. 1A-1C. A thermostat 201 displays different modes of operation of the multi-functional heat pump apparatus 100. A user or system controller selects 302 one of the modes, for example, cooling mode from the displayed options. Based on the selection of the cooling mode, the thermostat 201 signals the three-way switching valve 106 which switches 303 flow of the working medium. The working medium exchanges 304 with the air to be introduced into the given space using the indoor heat exchangers 101. An indoor fan 109 supplies 305 the heated, cooled, or dehumidified air to the given space.

Figure 4:
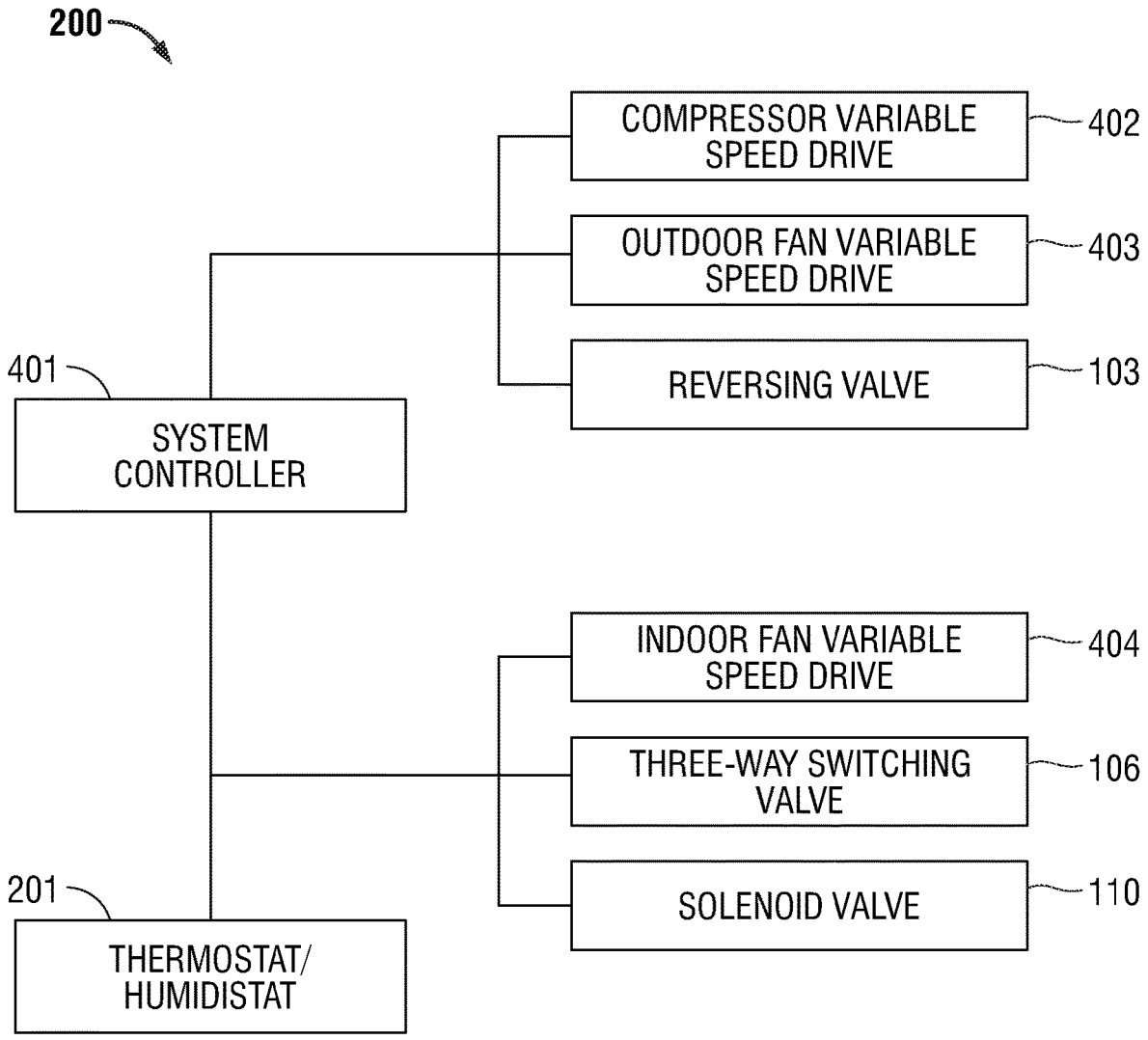
FIG. 4 is a block diagram showing the components of a multi-functional heat pump system in accordance with an embodiment of the present disclosure.

FIG. 4 illustrates a block diagram showing the components of an embodiment of a multi-functional heat pump system 200 in accordance with an embodiment of the present disclosure. The multi-functional heat pump system 200 includes a thermostat/humidistat 201 in operable communication with a system controller 401. In an embodiment, the compressor variable speed drive 402, the outdoor fan variable speed drive 403, and the reversing valve 103 are controlled by signals transmitted by the system controller 401. The system controller 401 controls the compressor speeds and the outdoor fan speeds. Additionally, the system controller 401 controls the reversing valve 103 to reverse the flow of the working medium during heating mode. The thermostat/humidistat 201 controls the operation of the three-way switching valve 106, the solenoid valve 110, the outdoor fan variable speed drive 403, and the indoor fan variable speed drive 404. The three-way switching valve 106 and the solenoid valve 110 always actuate simultaneously. In an embodiment, both the three-way switching valve 106 and the solenoid valve 110 are controlled by a single control circuit.

Figure 5:
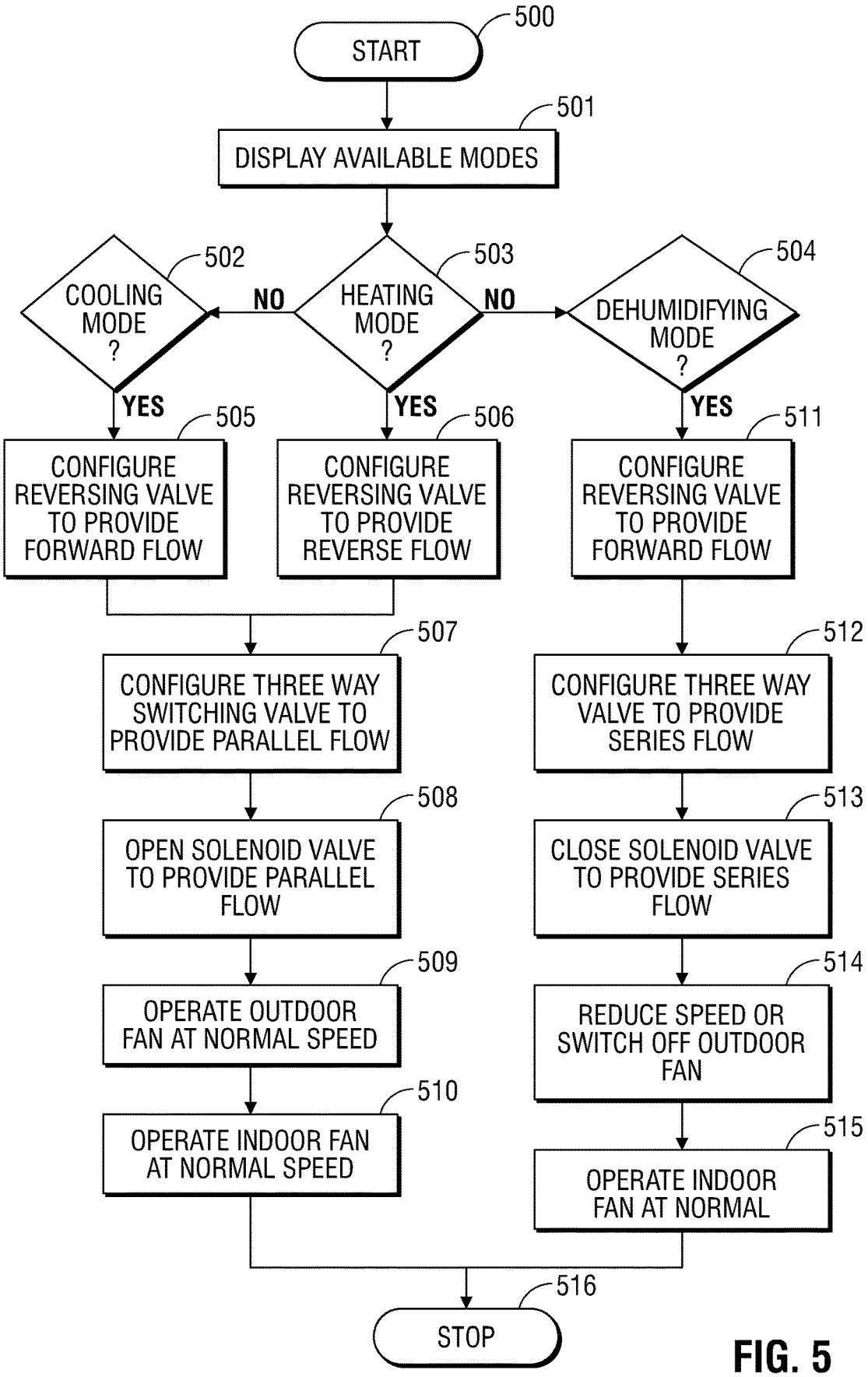
FIG. 5 is a flowchart showing working processes of a multi-functional heat pump apparatus for heating, cooling, and dehumidifying air in a given space in accordance with an embodiment of the present disclosure.

FIG. 5 illustrates a flowchart showing working processes of a multi-functional heat pump system 200 for heating, cooling, and dehumidifying air in a given space in accordance with an embodiment of the present disclosure. A user starts 500 a multi-functional heat pump apparatus 100. The thermostat/humidistat 201 of the multi-functional heat pump apparatus 100 displays 501 the optional modes, for example, a cooling mode, a heating mode, and a dehumidifying mode. The user or system controller selects a cooling mode 502, a heating mode 503, or a dehumidifying mode 504. If the cooling mode 502 or dehumidifying mode 504 is selected, the reversing valve 103 is configured 505 and 511 to provide forward flow. If the heating mode 503 is selected, the reversing valve 103 is configured 506 to provide reverse flow. The heating mode and cooling mode have similar flow positions of valves, that is, the three-way switching valves 106 are configured 507 to provide parallel flow. Furthermore, the solenoid valve 110 is opened 508 to provide parallel flow, the outdoor fan 111 is operated 509 at normal speeds, and the indoor fan 109 is operated 510 at normal speeds as disclosed in the detailed description of FIGS. 1A-1B. In dehumidifying mode the three-way switching valves 106 are configured 512 to provide series flow. Furthermore, the solenoid valve 110 is closed 513 to provide series flow, the outdoor fan 111 is operated 514 at reduced speeds, and the indoor fan 109 is operated 515 at normal speeds as disclosed in the detailed description of FIG. 1C.

Figure 6:
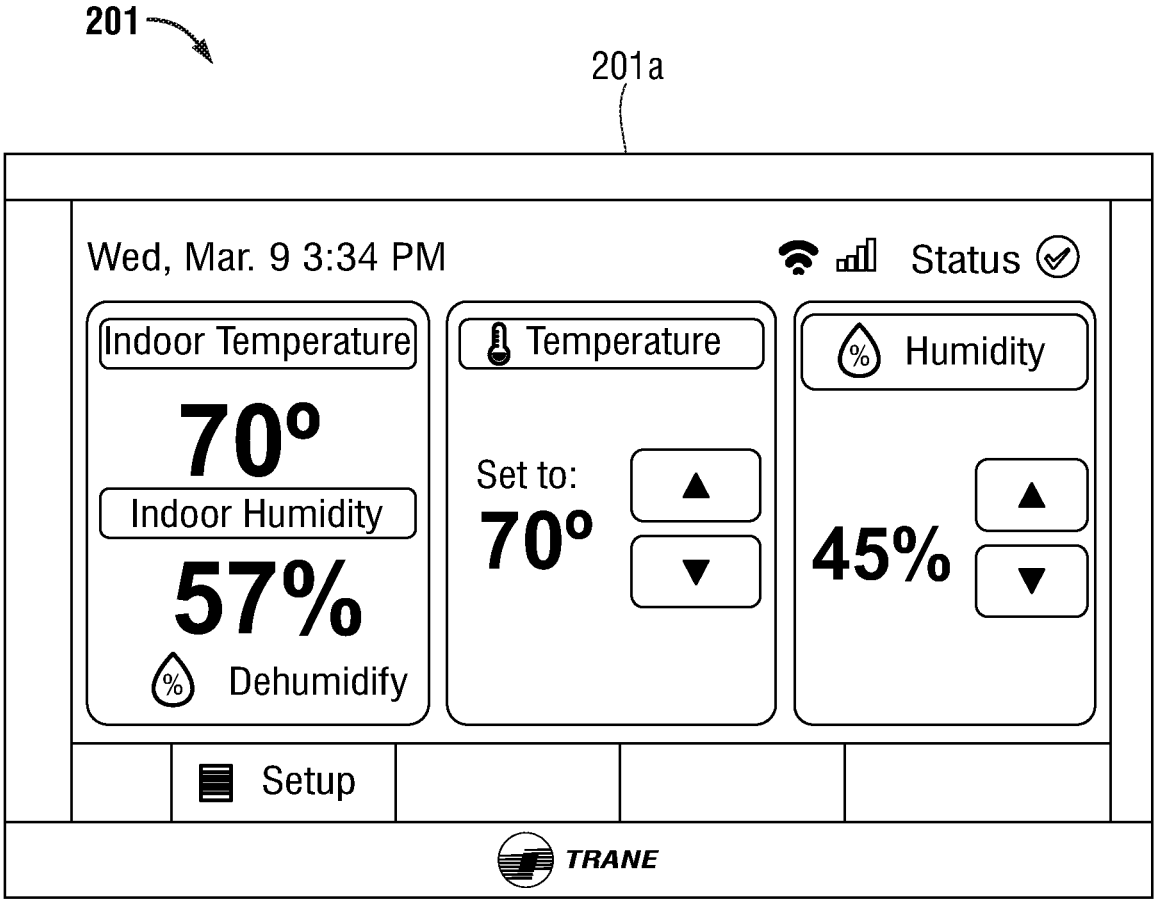
FIG. 6 illustrates a graphical user interface of a thermostat of a multi-functional heat pump system in accordance with an embodiment of the present disclosure.

FIG. 6 illustrates a graphical user interface **201*a* of a thermostat/humidistat 201 of a multi-functional heat pump system 200 in accordance with an embodiment of the present disclosure. In an embodiment, the graphical user interface 201*a* employs a touchscreen. The graphical user interface 201*a* displays various parameters, for example, room temperature, relative humidity, date, time, remaining battery power, etc. The temperature and relative humidity can be set according to the user. Once the temperature and relative humidity are set, the multi-functional heat pump system 200 operates as exemplarily illustrated in FIGS. 1A-1C** to maintain the required temperature and relative humidity conditions.

It should be understood that while the example embodiments in the foregoing description and drawings are directed to a heat pump system, the described cooling and dehumidifying modes are also suitable for use with an air conditioning-only type of system.

ASPECTS

It should be understood that any of aspects 1-8, any of aspects 9-17, and/or any of aspects 18-21 may be combined with each other in any combination.

Aspect 1. An indoor unit for use with a heating, ventilation, and air conditioning system, comprising an enclosure, a first coil assembly, and a second coil assembly, wherein in a cooling mode or a heating mode the first coil and second coil are in parallel fluid communication, and in a dehumidifying mode the first coil and second coil are in serial fluid communication.

Aspect 2. The indoor unit in accordance with aspect 1, wherein the first and/or second coil assembly comprises a heat exchanging coil having first and second ends, a thermal expansion valve coupled in series with a first end of the heat exchanging coil, and a reverse bypass valve coupled in parallel with the thermal expansion valve.

Aspect 3. The indoor unit in accordance with any of aspects 1-2, further comprising a first fluid circuit and a bypass fluid circuit, and a three-way valve which in the cooling mode or the heating mode directs working medium between the first fluid circuit and a first end of the first coil assembly and a first end of the second coil assembly, and which in the dehumidifying mode directs working medium between the first fluid circuit and a second end of the first coil assembly.

Aspect 4. The indoor unit in accordance with any of aspects 1-3, further comprising a second fluid circuit, and a solenoid valve which in the cooling mode or the heating mode directs working medium between the second fluid circuit and a second end of the first coil assembly and a second end of the first coil assembly, and which in the dehumidifying mode directs working medium between the second fluid circuit and a second end of the second coil assembly and prevents working fluid from flowing between the second fluid circuit and the second end of the first coil assembly.

Aspect 5. The indoor unit in accordance with any of aspects 1-4, further comprising a controller adapted to receive a control signal indicating an indoor unit state selected from the group consisting of cooling mode, heating mode, and dehumidifying mode.

Aspect 6. The indoor unit in accordance with any of aspects 1-5, wherein when the controller receives a control signal indicating an indoor unit state of cooling mode or heating mode, the controller causes the first coil assembly and the second coil assembly to be configured in parallel fluid communication.

Aspect 7. The indoor unit in accordance with any of aspects 1-6, wherein when the controller receives a control signal indicating an indoor unit state of dehumidifying mode, the controller causes the first coil assembly and the second coil assembly to be configured in a serial fluid communication.

Aspect 8. The indoor unit in accordance with any of aspects 1-7, wherein the first coil assembly and the second coil comprise first and second portions, respectively, of a single coil assembly.

Aspect 9. A method of operating a heating, cooling, and ventilation system to condition air of a given space, the method comprising providing an indoor unit comprising a first coil assembly and a second coil assembly, wherein the first coil assembly and the second coil assembly are individually configurable to operate in a heating mode or a cooling mode; cooling air of a given space by operating the first coil assembly and the second coil assembly in a cooling mode; heating air of a given space by operating the first coil assembly and the second coil assembly in a heating mode; and dehumidifying air of a given space by operating the first coil assembly in a heating mode and operating the second coil assembly in a cooling mode.

Aspect 10. The method of aspect 9, wherein cooling air of a given space includes coupling the first coil assembly and the second coil assembly in a parallel configuration.

Aspect 11. The method of any of aspects 9-10, further comprising operating the first coil assembly and the second coil assembly as evaporator coils.

Aspect 12. The method of any of aspects 9-11, wherein heating air of a given space includes coupling the first coil assembly and the second coil assembly in a parallel configuration.

Aspect 13. The method of any of aspects 9-12, further comprising operating the first coil assembly and the second coil assembly as condenser coils.

Aspect 14. The method of any of aspects 9-13, wherein dehumidifying air of a given space includes coupling the first coil assembly and the second coil assembly in a series configuration.

Aspect 15. The method of any of aspects 9-14, further comprising operating the first coil assembly as a condenser coil and operating the second coil assembly as an evaporator coil.

Aspect 16. The method of any of aspects 9-15, wherein dehumidifying air of a given space includes reducing the speed of an outdoor coil fan of an outdoor unit coupled to the indoor unit.

Aspect 17. The method of any of aspects 9-16, wherein dehumidifying air of a given space includes deactivating an outdoor coil fan of an outdoor unit coupled to the indoor unit.

Aspect 18. A system for heating, cooling, and dehumidifying air of a given space, comprising a thermostat comprising a graphical user interface for rendering information and displaying a selection of a plurality of modes, the graphical user interface configured to receive a selection of a mode from a user; at least one processor configured to execute computer program instructions defined by modules of the thermostat, the modules comprising: a data communications module configured to receive sensor data variables from one or more sensing devices, the sensing devices configured to send an environmental parameter of the given space; an analysis module configured to dynamically analyze the received sensor data variables to determine an environmental state of the given space and generate a control signal based on based on the received mode selection and the determined state of the given space; a control module operatively coupled to the thermostat and configured to control one or more auxiliary units based on the control signal; and an indoor unit, comprising: a first coil assembly; a second coil assembly; and an auxiliary unit operatively associated with the first coil assembly and the second coil assembly and responsive to the control module to configure in a cooling mode or a heating mode the first coil and second coil in parallel fluid communication, and to configure in a dehumidifying mode the first coil and second coil in serial fluid communication.

Aspect 19. The system of aspect 18, wherein the one or more sensing devices generate a variable indicative of ambient temperature, ambient pressure, and/or ambient humidity of the given space.

Aspect 20. The system of any of aspects 18-19, wherein the auxiliary units are selected from the group consisting of a three way valve and a solenoid valve.

Aspect 21. The system of any of aspects 18-20, further comprising an outdoor unit having a heat exchanger fan, wherein the control module is in communication with the heat exchanger fan and is configured to operate the fan at reduced speed during dehumidifying mode.

Particular embodiments of the present disclosure have been described herein, however, it is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in any appropriately detailed structure.

What is claimed is:

1. A method of operating a heating, cooling, and ventilation system to condition air of a given space, the method comprising:

providing an indoor unit comprising:

first and second heat exchange coils, each having first and second ends;

first and second expansion units, each having first and second ends, each expansion unit comprising an expansion valve arranged in parallel with a bypass valve; and a valve having a first port selectively coupleable to a second port and a third port, wherein the first end of the first coil is coupled to the first end of the first expansion unit, the first end of the second coil is coupled to the first end of the second expansion unit, and the second port of the valve is coupled to the second end of the first expansion unit and the second end of the second expansion unit;

cooling air of the given space by operating the first coil and the second coil in a cooling mode wherein the direction of flow of the working medium causes the working medium to bypass the respective expansion valve of the first coil and the second coil;

heating air of the given space by operating the first coil and the second coil in a heating mode wherein the direction of flow of the working medium causes the working medium to flow through the respective expansion valve of the first coil and the second coil; and dehumidifying air of the given space by operating the first coil in a cooling mode wherein the direction of flow of the working medium causes the working medium to bypass the expansion valve of the first coil and operating the second coil in a heating mode wherein the direction of flow of the working medium causes the working medium to flow through the expansion valve of the second coil.

2. The method of claim 1, wherein cooling air of the given space includes positioning the valve to cause the working medium to flow through the first coil and the second coil in parallel.

3. The method of claim 1, wherein cooling air of the given space includes operating the first coil and the second coil as evaporator coils.

4. The method of claim 1, wherein heating air of the given space includes positioning the valve to cause the working medium to traverse the first coil and the second coil in parallel.

5. The method of claim 1, wherein heating air of the given space includes operating the first coil and the second coil as condenser coils.

6. The method of claim 1, wherein dehumidifying air of the given space includes positioning the valve to cause the working medium to flow through the first coil and the second coil in series.

7. The method of claim 1, wherein dehumidifying air of the given space includes operating the first coil as a condenser coil and operating the second coil as an evaporator coil.

8. The method of claim 1, wherein dehumidifying air of the given space includes reducing the speed of an outdoor coil fan of an outdoor unit coupled to the indoor unit.

9. The method of claim 1, wherein dehumidifying air of the given space includes deactivating an outdoor coil fan of an outdoor unit coupled to the indoor unit.

* * * * *